US011401074B2

(12) United States Patent
Haufrect

(10) Patent No.: US 11,401,074 B2
(45) Date of Patent: Aug. 2, 2022

(54) VERTICALLY CONNECTING BOTTLES FOR WINE AND OTHER LIQUIDS

(71) Applicant: Mark Haufrect, Fairfax, VA (US)

(72) Inventor: Mark Haufrect, Fairfax, VA (US)

( * ) Notice: Subject to any disclaimer, the term of this patent is extended or adjusted under 35 U.S.C. 154(b) by 0 days.

(21) Appl. No.: 17/233,428

(22) Filed: Apr. 16, 2021

(65) Prior Publication Data

US 2021/0323726 A1 Oct. 21, 2021

Related U.S. Application Data

(63) Continuation-in-part of application No. 29/737,268, filed on Jun. 8, 2020.

(60) Provisional application No. 63/011,141, filed on Apr. 16, 2020.

(51) Int. Cl.
*B65D 21/02* (2006.01)
*B65D 1/02* (2006.01)

(52) U.S. Cl.
CPC ..... *B65D 21/0228* (2013.01); *B65D 1/0246* (2013.01); *B65D 1/0261* (2013.01)

(58) Field of Classification Search
CPC ..... B65D 21/0228; B65D 1/0246; B65D 21/0231; B65D 1/0276
USPC ..... 215/10
See application file for complete search history.

(56) References Cited

U.S. PATENT DOCUMENTS 769,615 A * 9/1904 Kosansvich ..... B65D 21/0231 215/10
2,077,027 A * 4/1937 Torras ..... B65D 21/0231 206/508
2,641,374 A * 6/1953 Der Yuen ..... B65D 21/0231 215/10
2,960,248 A * 11/1960 Kuhlman ..... B65D 21/0231 215/10

(Continued)

FOREIGN PATENT DOCUMENTS

CA 2915752 C 6/2017

OTHER PUBLICATIONS

Accmor Baby Milk Powder Formula Dispenser, Non-Spill Stackable Snack Storage Formula Container, BPA Free, 3 Layers, 2 Pack, amazon.com.

(Continued)

*Primary Examiner* — Ernesto A Grano

(57) ABSTRACT

A stackable bottle system is a modular apparatus used to present a tasting set of wines, or other separate beverages and liquids, in a user-configurable unit assembled from multiple independent containers. The stackable bottle system utilizes a plurality of interlocking bottles, each individually formed from a core container, a protruding engagement structure, a recessed engagement structure, and a separable seal. The separable seal is mounted over an opening in the core container, enclosing a reservoir. The core container provides a hollow body to retain any liquid therein. The protruding engagement structure and the recessed engagement structure are integrated into the core container at a neck end and a base end, respectively. The protruding engagement structure of an arbitrary bottle is engaged into the recessed engagement structure of an adjacent bottle to form the basis for the modular assembly of the present invention.

5 Claims, 7 Drawing Sheets

(56) References Cited

U.S. PATENT DOCUMENTS 5,887,740 A * 3/1999 Hong ..... B65D 21/0231 220/4.27
5,927,499 A * 7/1999 Vesborg ..... B65D 1/0292 206/509
6,276,549 B1 * 8/2001 Fasci ..... B65D 21/0202 220/23.4
6,588,612 B1 * 7/2003 Dorn ..... B65D 1/18 206/509
D487,697 S * 3/2004 Rosen ..... D9/519
7,644,828 B1 * 1/2010 Klein ..... A63H 33/067 215/10
8,348,051 B2 * 1/2013 Furey ..... B65D 23/00 206/220
8,695,826 B2 * 4/2014 Furey ..... A47G 19/2205 220/23.83
9,278,781 B1 * 3/2016 Boldis ..... B65D 21/0231
9,656,782 B2 * 5/2017 Park ..... B65D 17/4012
9,789,997 B2 * 10/2017 Eble ..... B65D 21/0231
10,279,977 B2 * 5/2019 Fleischman ..... B65D 81/3211
10,293,976 B2 * 5/2019 Klein ..... B65D 21/0231
D902,055 S * 11/2020 Patel ..... D9/745
2004/0020890 A1 2/2004 Tan et al.
2006/0000740 A1 1/2006 Sigur
2007/0114200 A1 5/2007 Lane
2009/0045157 A1 * 2/2009 Panchai ..... B65D 21/0231 215/10
2009/0255893 A1 * 10/2009 Zummo ..... B65D 1/0223 215/10
2009/0266782 A1 * 10/2009 Lane ..... B65D 1/023 215/10
2011/0226719 A1 * 9/2011 Park ..... B65D 17/4012 215/10
2012/0018997 A1 1/2012 Roberts
2012/0055835 A1 3/2012 Nurdag
2012/0325766 A1 * 12/2012 Boisvert ..... A01G 25/14 215/10
2013/0048592 A1 * 2/2013 Carley ..... B65D 1/0269 215/302
2014/0027336 A1 1/2014 Bou Mezrag et al.
2014/0326693 A1 * 11/2014 Martin ..... B65D 21/0231 215/10
2016/0200495 A1 * 7/2016 Saito ..... B65D 1/0276 206/499
2016/0362225 A1 * 12/2016 Boaventura-Delanoe ..... B65D 21/0231
2017/0247142 A1 * 8/2017 Pedmo ..... B65D 1/023

OTHER PUBLICATIONS

Clear Glass 3 Spice Jars That Stack to Look Like a Wine Bottle, etsy.com.

* cited by examiner

VERTICALLY CONNECTING BOTTLES FOR WINE AND OTHER LIQUIDS

BACKGROUND OF THE INVENTION

The current application claims a priority to the U.S. Provisional Patent application Ser. No. 63/011,141 filed on Apr. 16, 2020.

FIELD OF THE INVENTION

The present invention relates generally to beverage receptacles, specifically beverage receptacles that interconnect to each other to form a user-configurable assembly from multiple modular units.

Beverage receptacles such as wine bottles are oftentimes organized through the use of wine racks, organizers, or shelves. The requirement of additional organizing media may serve as an inconvenience in certain instances. In one instance, wine bottle sampler packs usually associate with disposable packaging. Once unpacked, the separate wine bottles are an inconvenience to the user. Due to their small or unorthodox shape and size, they are difficult to organize and keep together in conventional wine racks, organizers, or shelves. Therefore, it is an objective of the present invention to provide a means to organize and keep multiple bottles together such that they can be stored in wine racks, organizers, or shelves.

The present invention features an interconnectable bottle that allows the user to connect multiple bottles into a desired size, allowing smaller, interconnected bottles to form a full-sized wine bottle that can be readily stored and handled through conventional means. Additionally, the present invention facilitates less disposable packaging, as the stacked interconnected bottles that forms the full-sized bottle can be packaged as a full-sized wine bottle.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIG. 1 through 7, the present invention is a stackable bottle system comprising a plurality of interlocking bottles 10. The plurality of interlocking bottles 10 broadly refers to a series of mutually compatible, positionally-agnostic modular units that may individually define varying dimensions, capacities, and physical properties as may be suitable for storing a variety of liquid compounds. In a preferred mode of use, each of the plurality of interlocking bottles 10 is filled with differing varieties of wines, whereby a customizable tasting of said varieties may be stored, transported, and presented as a single assembled unit. However, no limitations should be implied to alternate embodiments of the present invention utilized for handling other liquids; any type or combination of fluid or semi-fluid compound may be stored within the plurality of interlocking bottles 10 without departing from the original spirit and scope of the present invention.

Figure 1:
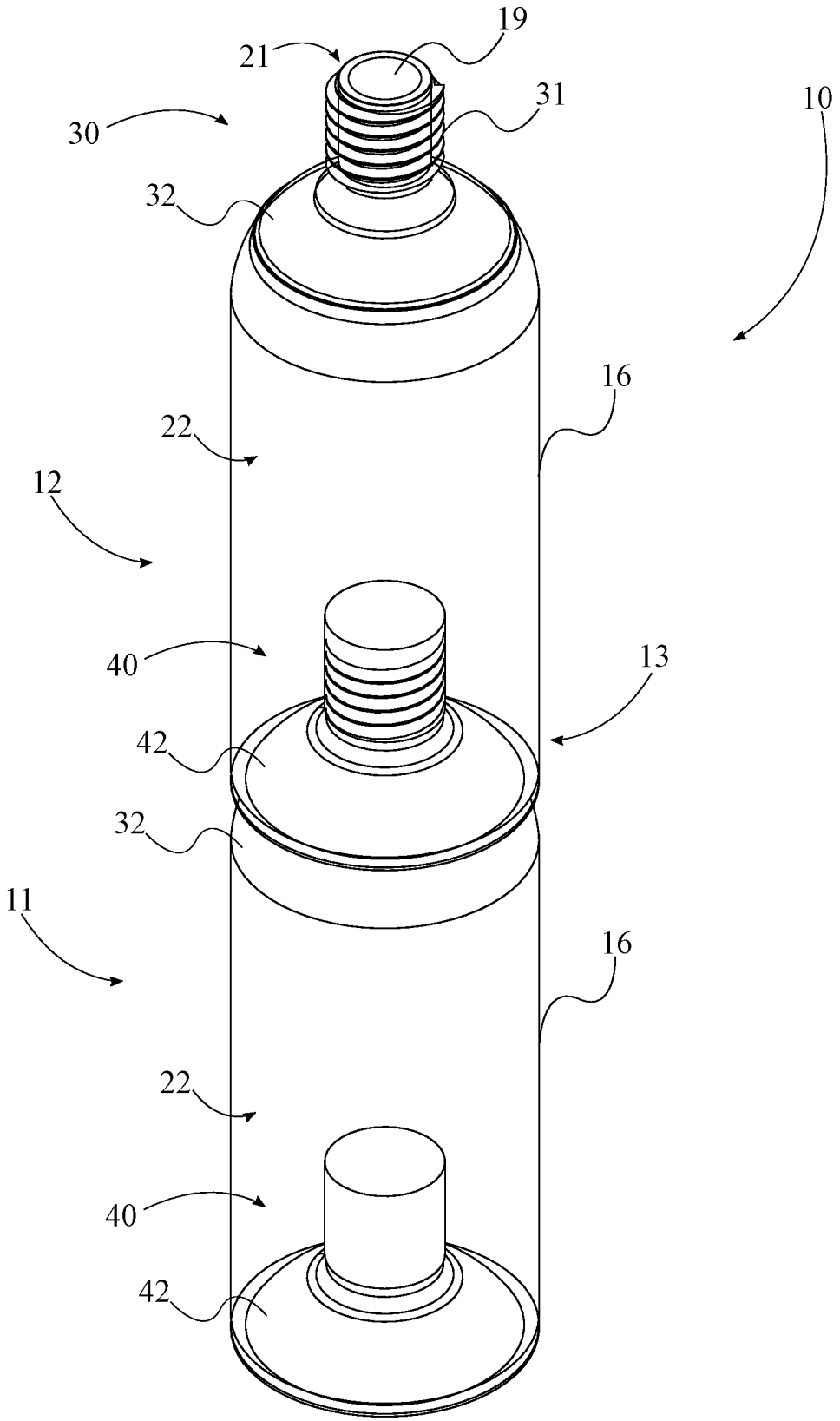
FIG. 1 is a top-front-left perspective view of one embodiment of the present invention, wherein portions of the present invention are rendered transparent to illustrate construction.
Figure 2:
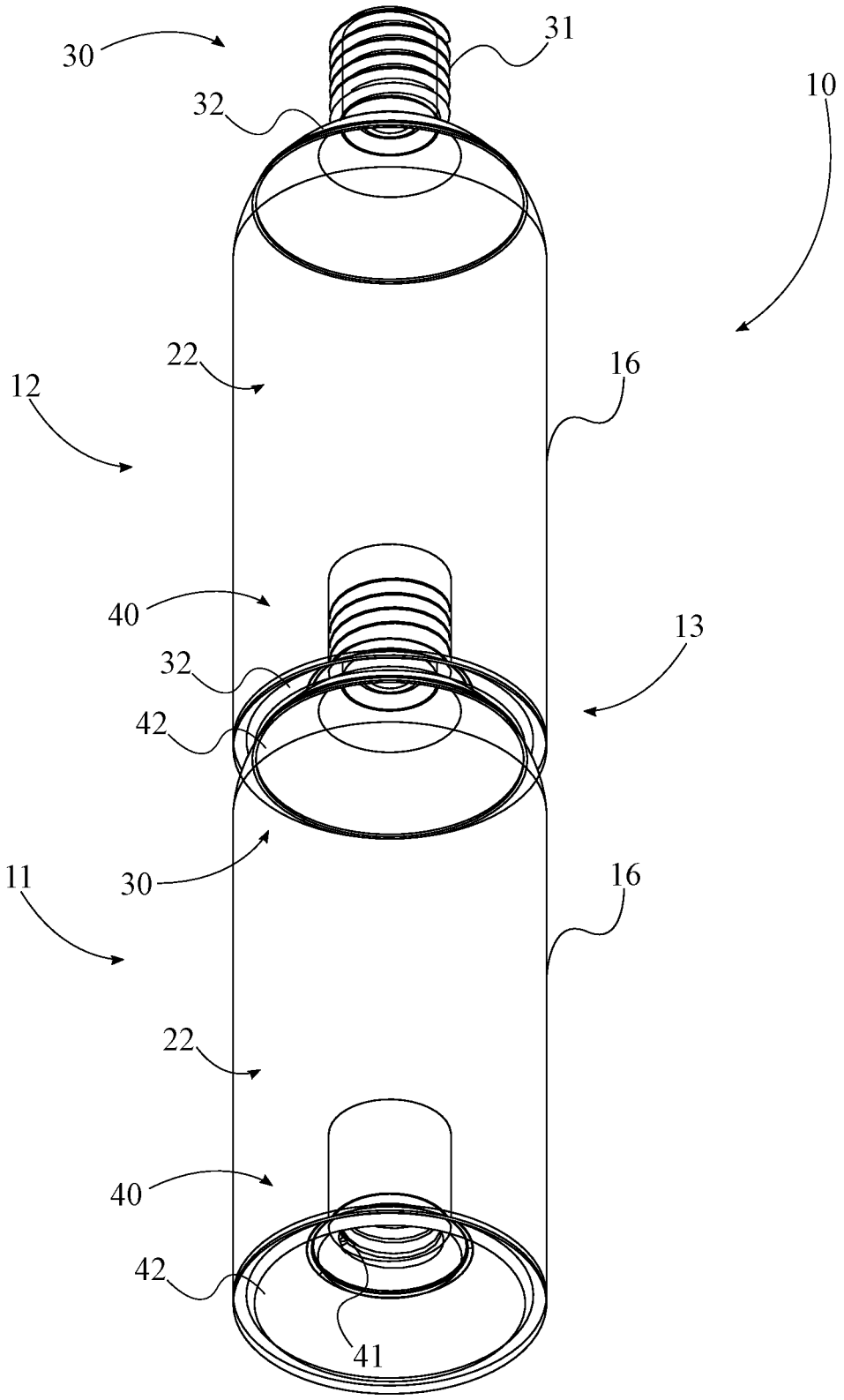
FIG. 2 is a bottom-right-rear perspective view thereof.

In reference to FIGS. 1 and 2, each of the plurality of interlocking bottles 10 further comprises a core container 16, a protruding engagement structure 30, a recessed engagement structure 40, and a separable seal 19. In a preferred embodiment of the present invention, each of the plurality of interlocking bottles 10 is functional as a standalone beverage container. In general, the core container 16 retains the beverage, the protruding engagement structure 30 and the recessed engagement structure 40 interconnect multiple iterations of the core container 16, and each iteration of the separable seal 19 encloses the beverage within each core container 16.

The core container 16 constitutes the primary beverage storage medium for any liquids stored within each of the plurality of interlocking bottles 10. The core container 16 may be manufactured from any suitable material or combination of materials, though this component is ideally formed from blown glass to retain similarity to conventional wine bottles for presentation purposes. Alternate embodiments of the core container 16 may also be manufactured any suitable material, including any plastics, polymers, metallic materials, or any combination thereof.

The protruding engagement structure 30 and the recessed engagement structure 40 each define individually manufactured components suitable for engagement to each other. The independent manufacture of these components, separate from the core container 16, enables the tolerances of the core container 16 to remain relatively loose in comparison to the finer tolerances of the protruding engagement structure 30 and the recessed engagement structure 40. Further, the separation of these components prior to final assembly enables the use of differing composite materials in the manufacture of the core container 16, the protruding engagement structure 30, and the recessed engagement structure 40. This arrangement provides utility in embodiments wherein a glass iteration of the core container 16 would be unsuitable to bear the stresses of the at least one mechanical interlock 13, resulting in cracks, shorn-off features, or a generally loose fit between the plurality of interlocking bottles 10. Alternatively, an injection-molded protruding engagement structure 30 and recessed engagement structure 40 may survive said stresses, whilst providing a tighter physical lockup between the plurality of interlocking bottles 10.

The separable seal 19 constitutes any means of retaining a fluid inside the core container 16. This broadly encompasses any caps, corks, lids, or other closures as may be realized by an individual of ordinary skill. More specifically, the separable seal 19 defines a closure that is separate from the protruding engagement structure 30 and the recessed engagement structure 40, thereby enabling each core container 16 to remain closed even when detached from the plurality of interlocking bottles 10.

The core container 16 extends between a neck end 17 and a base end 18, wherein the neck end 17 is roughly analogous to the tapered shoulder and neck of a conventional wine bottle and the base end 18 defines a flared support base for the core container 16. An opening 21 is formed into the neck end 17 through the primary engagement structure and the separable seal 19 is releasably mounted over the opening 21. A reservoir 22 is formed into the core container 16 between the base end 18 and the neck end 17, wherein the reservoir 22 is in fluid communication with the opening 21. The reservoir 22 defines the hollow volume within the core container 16 in which a beverage or other liquid may be stored. The dimensions of the reservoir 22 may vary across multiple embodiments, dependent on the necessary wall thickness of the core container 16 to maintain the integrity of the reservoir 22 (e.g., a metallic core container 16 may have a larger reservoir 22 than a glass core container 16 relative to the thickness of the core container 16 material).

Figure 3:
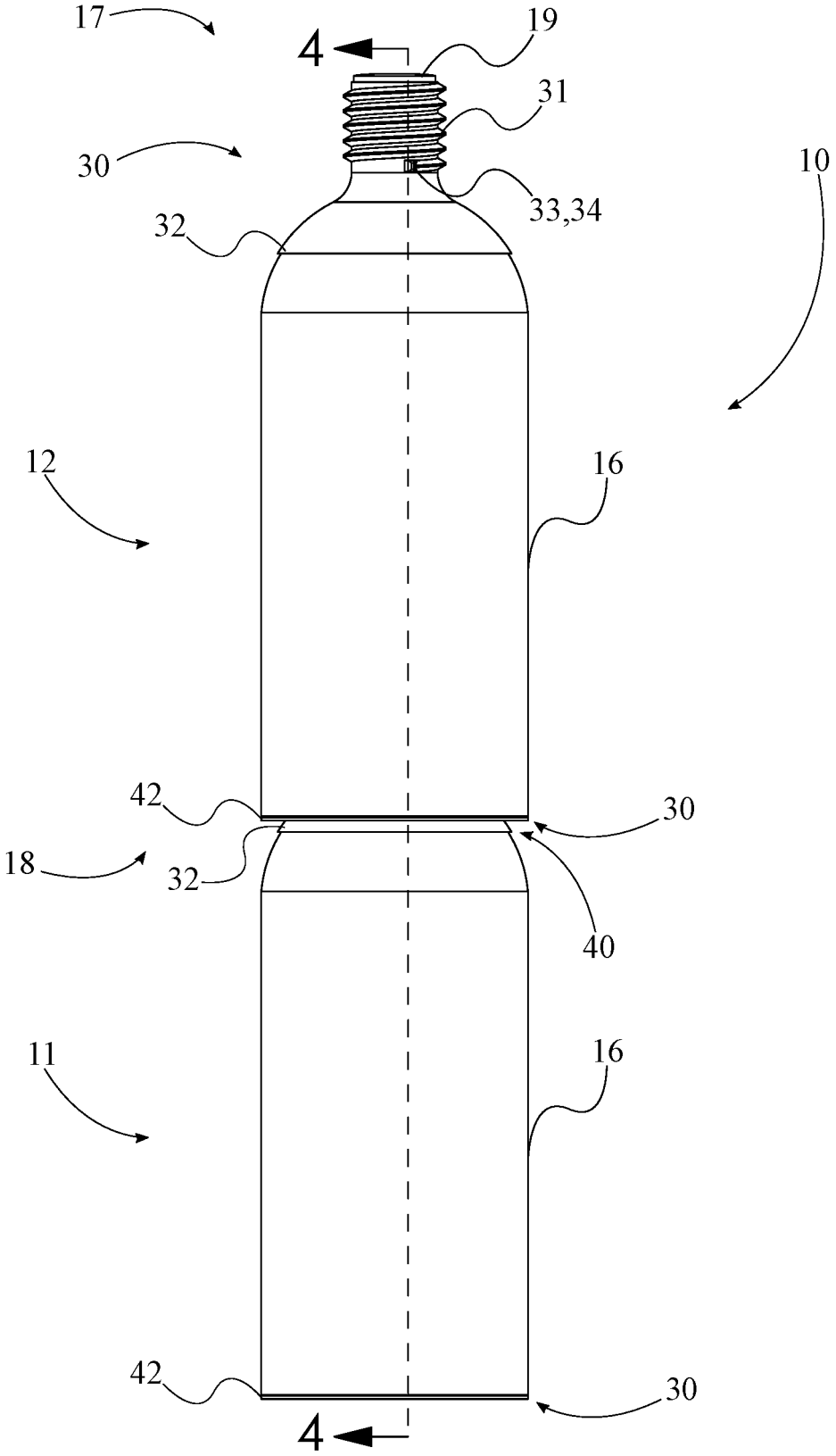
FIG. 3 left-side elevational view thereof.

The protruding engagement structure 30 is integrated into the core container 16 at the neck end 17, around the opening 21. The recessed engagement structure 40 is integrated into the core container 16 at the base end 18. The arrangement of the protruding engagement structure 30 and the recessed engagement structure 40 on opposite ends of the core container 16 enables the linear arrangement of the plurality of interlocking bottles 10 as shown in FIG. 1 through 3. Referring to the means of integration, it is contemplated that the core container 16, the protruding engagement structure 30, and the recessed engagement may be assembled utilizing any known means or methods for joining dislike materials as may be realized by a person of ordinary skill.

At least one mechanical interlock 13 is formed between the protruding engagement structure 30 and the recessed engagement structure 40, wherein a first mating formation 31 of the mechanical interlock 13 is dispersed along the protruding engagement structure 30 and a second mating formation 41 of the mechanical interlock 13 is dispersed along the recessed engagement structure 40. To form a conjoined assembly, the protruding engagement structure 30 of an arbitrary bottle 11 from the plurality of interlocking bottles 10 is releasably engaged to the recessed engagement structure 40 of an adjacent bottle 12 from the plurality of interlocking bottles 10 by the mechanical interlock 13.

The mechanical interlock 13 broadly defines a means of physically attaching each of the plurality of interlocking bottles 10 to each other, thereby enabling a user to mix-and-match different arrangements of the plurality of interlocking bottles 10. Accordingly, the first mating formation 31 and the second mating formation 41 define mutually compatible mechanical features capable of releasably fixing any matched pair of the protruding engagement structure 30 and the recessed engagement structure 40 together. In the preferred embodiment, the first mating formation 31 and the second mating formation 41 define a set of male and female surface threads, wherein the mechanical interlock 13 is characterized as a threaded connection between each of the plurality of interlocking bottles 10. In various alternate embodiments, the first mating formatting and the second mating formation 41 of the mechanical interlock 13 may be characterized as any other form of releasable mechanical fixture without departing from the original spirit and scope of the present invention.

In a preferred embodiment of the present invention, the neck end 17 of the core container 16 is substantially convex, and the base end 18 of the core container 16 is substantially concave. This opposed complimentary surface geometry enables each of the core container 16 defined within the plurality of interlocking bottles 10 to effectively nest together, creating a relatively uniform silhouette and profile between the arbitrary bottle 11 and the adjacent bottle 12. More specifically, the base end 18 of the core container 16 of the adjacent bottle 12 is configured to receive the neck end 17 of the arbitrary bottle 11, such that the combined assembly of the plurality of interlocking bottles 10 can appear visually analogous to conventional beverage containers as illustrated in FIG. 3.

Figure 4:
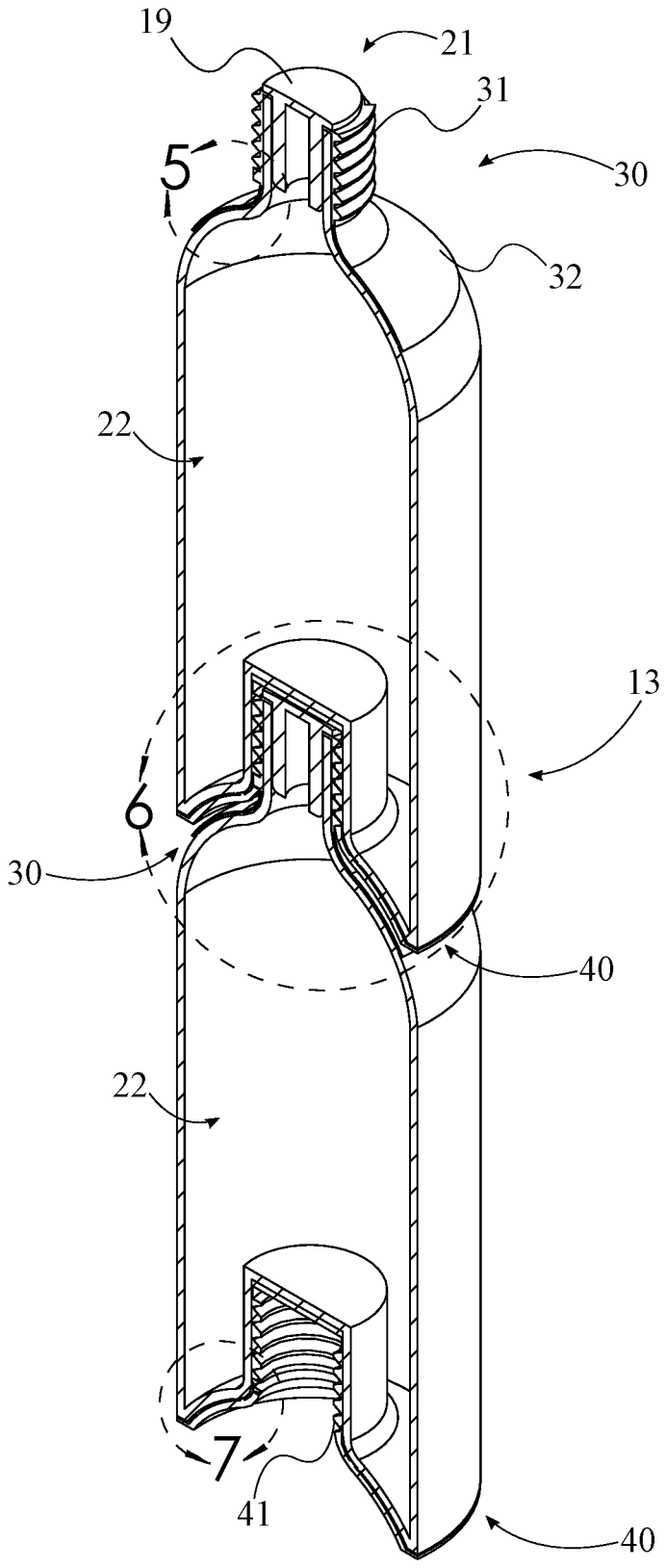
FIG. 4 is a section view taken along line 4-4 in FIG. 3.

The separable seal 19 encloses the core container 16 of the arbitrary bottle 11 and maintains the integrity of the reservoir 22, independent of the adjacent bottle 12. This arrangement enables each of the plurality of interlocking bottles 10 to be filled, sealed, packaged, and generally handled as conventional bottles until a user creates a stacked assembly for presentation. This arrangement further enables the plurality of interlocking bottles 10 to be rearranged without risking spillage from any of the plurality of interlocking bottles 10. Consequently, it is necessary for the separable seal 19 of the arbitrary bottle 11 to be offset from any portion of the adjacent bottle 12, such that the engagement of the arbitrary bottle 11 thereto does not disturb the separable seal 19. Accordingly, the recessed engagement structure 40 further comprises a seal-receiving cavity 46. The separable seal 19 being removably positioned into the seal-receiving cavity 46, wherein a minimum diameter 14 of the mechanical interlock 13 is greater than a maximum diameter 20 of the separable seal 19 as shown in FIG. 4. In conception, the difference between the minimum diameter 14 and the maximum diameter 20 constitutes suitable tolerance to enable the mechanical interlock 13 and the separable seal 19 to remain independent in all configurations of the present invention.

Figure 5:
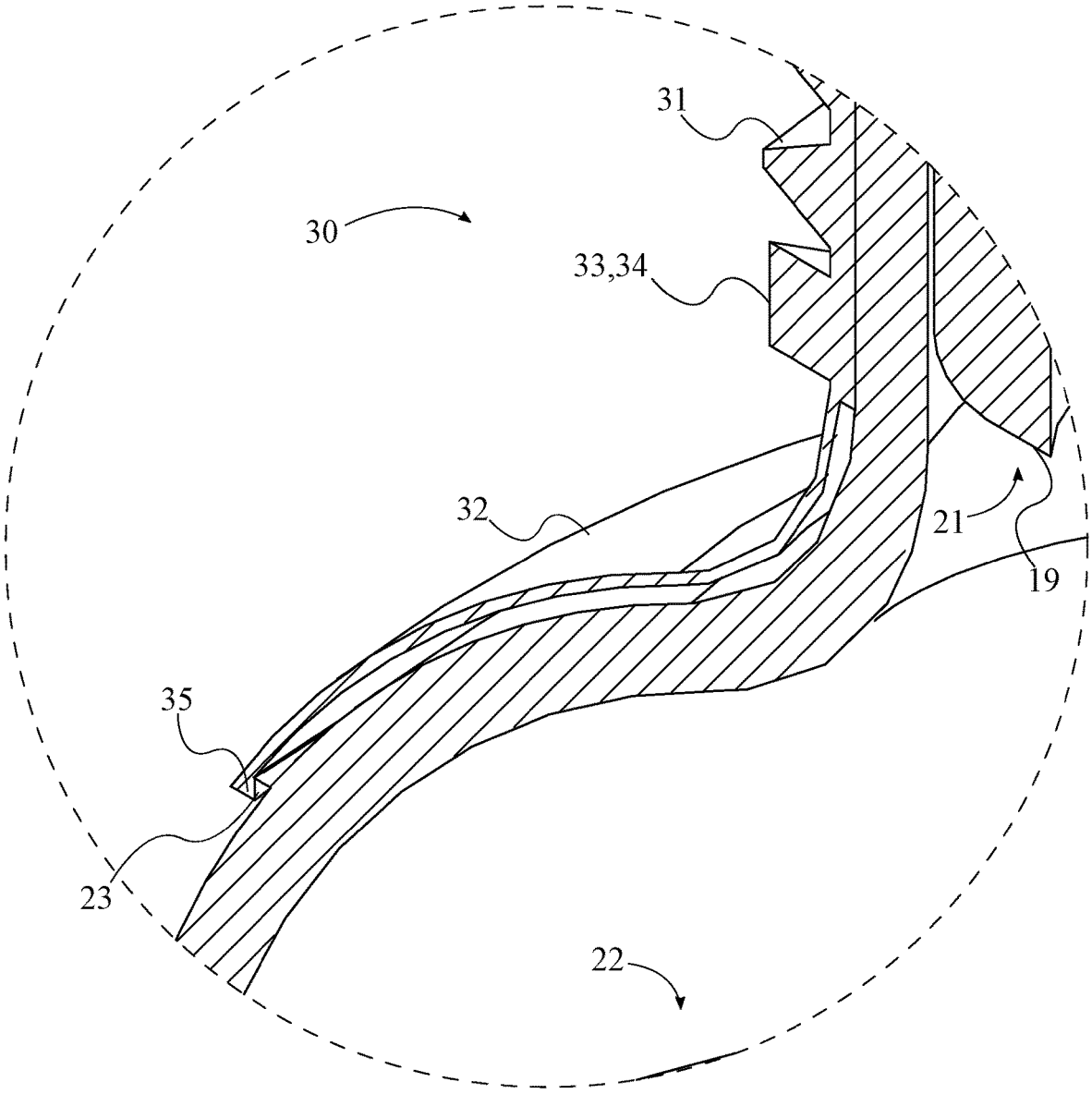
FIG. 5 is a detail view of area 5 in FIG. 4.

In at least one embodiment, the integration of the protruding engagement structure 30 and the recessed engagement structure 40 to the core container 16 may be guided by structures integral to the core container 16 itself. More specifically, the relatively large tolerances of a blown-glass core container 16 may be used to position and retain finer-tolerance components into functional positions on the core container 16. As shown in FIG. 5, the core container 16 further comprises an upper mounting shelf 23 extending radially outwards from the opening 21, adjacent to the neck end 17, and the protruding engagement structure 30 further comprises an internal lip 35 extending radially inwards, opposite the first mating formation 31. The upper mounting shelf 23 is captured by the upper internal lip 35, whereby the protruding engagement structure 30 is rotationally and translationally bound to the core container 16. This arrangement of compatible features on disparate components is proposed to simplify manufacture of the present invention without substantially increasing the complexity of any constituent components. It is further considered that the engagement of the upper mounting shelf 23 and the internal lip 35 may be supplemented with other forms of permanent fixation, such as adhesive compounds or material weldments.

Figure 7:
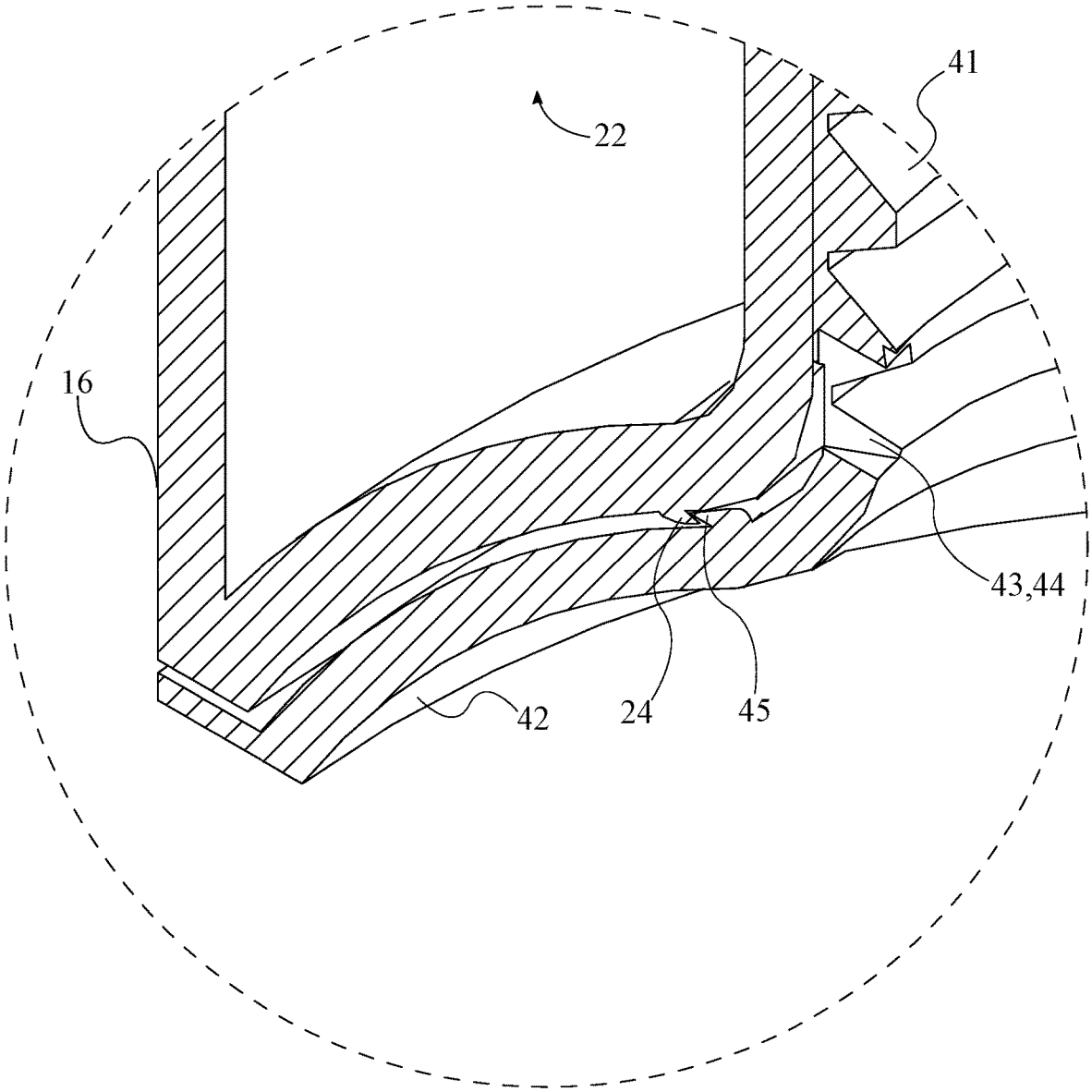
FIG. 7 is a detail view of area 7 in FIG. 4.

A similar arrangement to the feature described above may be employed to position the recessed engagement structure 40 onto the core container 16. As shown in FIG. 7, the core container 16 further comprises a lower mounting shelf 24 extending radially inwards, adjacent to the base end 18, and the recessed engagement structure 40 further comprises an external lip 45 extending radially outwards, opposite the second mating formation 41. The lower mounting shelf 24 is captured by the external lip 45, whereby the recessed engagement structure 40 is rotationally and translationally bound to the core container 16.

Figure 6:
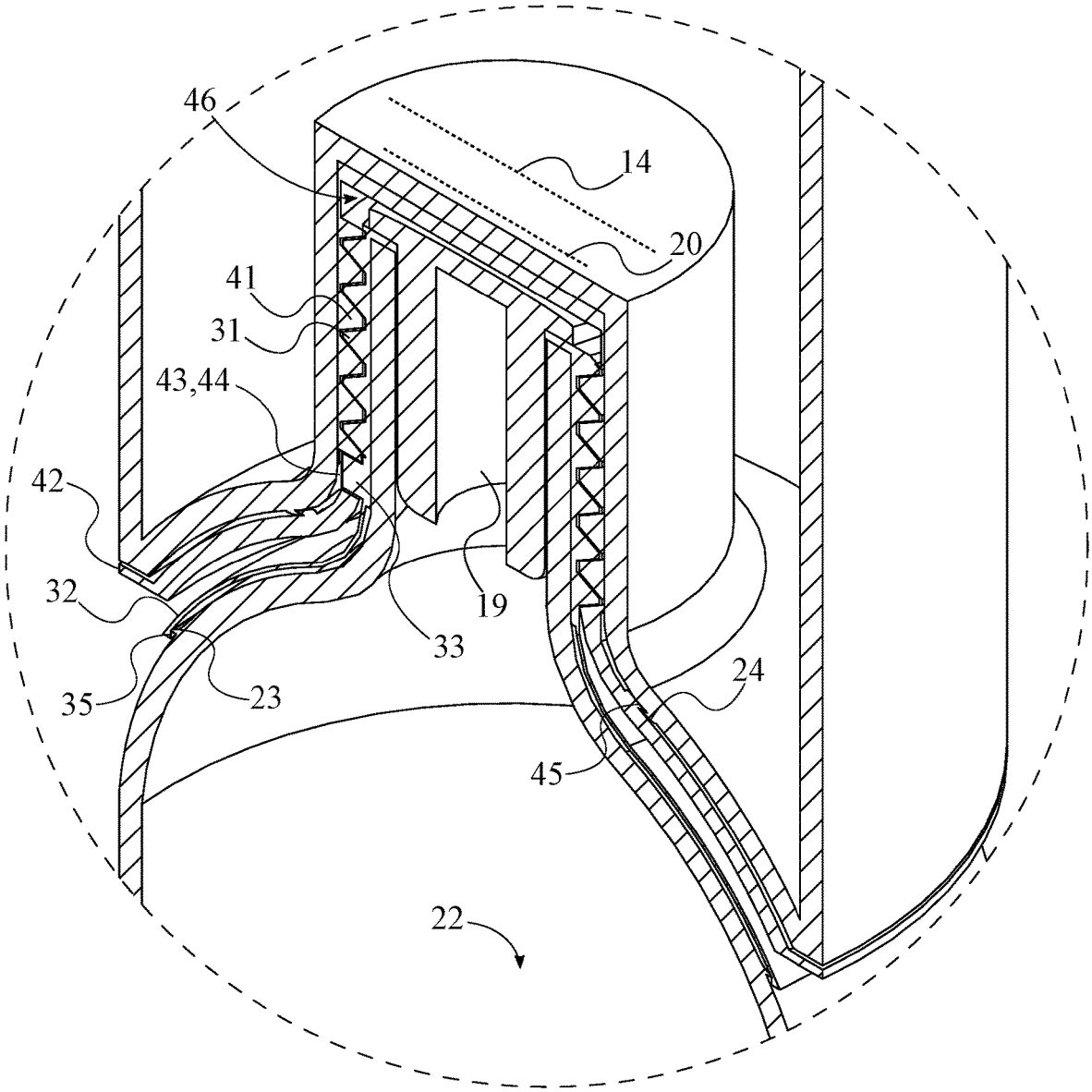
FIG. 6 is a detail view of area 6 in FIG. 4.

It is considered that the use of potentially fragile materials (i.e., glass) in the construction of the core container 16 may necessitate special handling to avoid breakage. This material weakness may be exacerbated by direct contact between the arbitrary bottle 11 and the adjacent bottle 12. Therefore, it is further proposed that the protruding engagement structure 30 and the recessed engagement structure 40 may function as impact buffers between the arbitrary bottle 11 and the adjacent bottle 12 in any configuration. More specifically, the protruding engagement structure 30 further comprises a first collar 32 positioned adjacent to the first mating formation 31, wherein the first collar 32 conforms to the curvature of the neck end 17 of the arbitrary bottle 11. The recessed engagement structure 40 further comprises a second collar 42 positioned adjacent to the second mating formation 41, wherein the second collar 42 conforms to the curvature of the base end 18 of the adjacent bottle 12. As shown in FIG. 6, the engagement of the arbitrary bottle 11 to the adjacent bottle 12 brings the first collar 32 into proximity to, or contact with, the second collar 42. In this position, the first collar 32 and the second collar 42 are configured to deflect relative to each other across the at least one mechanical interlock 13 to absorb any potentially damaging forces exerted between the arbitrary bottle 11 and the adjacent bottle 12.

As described, the mechanical interlock 13 provides a functional means of combining the arbitrary bottle 11 and the adjacent bottle 12 into a single unit. However, the preferred embodiment of the mechanical interlock 13 (i.e., a threaded connection) is susceptible to accidental disengagement if the first mating formation 31 and the second mating formation 41 are partially disengaged. In this embodiment, the arbitrary bottle 11 may be spun free of the adjacent bottle 12 if the mechanical interlock 13 is not perfectly formed. Therefore, it is further proposed the protruding engagement structure 30 further comprises at least one first terminal locking feature 33 and the recessed engagement structure 40 further comprises at least one second terminal locking feature 43. As shown in FIG. 6, the first terminal locking feature 33 is radially positioned about the opening 21, wherein the first terminal locking feature 33 is engaged to the second terminal locking feature 43 through rotation of the arbitrary bottle 11 relative to the adjacent bottle 12. This secondary fixation between the first terminal locking feature 33 and the second terminal locking feature 43 will ideally require a specific and intentional force to be exerted across the mechanical interlock 13 to disengage the arbitrary bottle 11 from the adjacent bottle 12. Further, the position of the first terminal locking feature 33 and the second terminal locking feature 43 may be configured to rotationally index the arbitrary bottle 11 relative to the adjacent bottle 12. This arrangement may prevent a user from over-turning or otherwise mispositioning the mechanical interlock 13, thereby ensuring that the first mating formation 31 and the second mating formation 41 are properly positioned in all configurations.

As illustrated in FIGS. 5 and 7, the preferred embodiment of the first terminal locking feature 33 and the second terminal locking feature 43 constitute irregular rotary locking features configured to engage between the arbitrary bottle 11 and the adjacent bottle 12 when the first mating formation 31 and the second mating formation 41 are fully seated, rotated, or otherwise engaged into each other. More specifically, the at least one first terminal locking feature 33 is a first interrupted thread 34 positioned adjacent to the first mating formation 31, proximal to the core container 16. Likewise, the at least one second terminal locking feature 43 is a second interrupted thread 44, positioned adjacent to the second mating formation 41 proximal to the core container 16. As shown in FIG. 6, the first interrupted thread 34 and the second interrupted thread 44 are removably engaged with each other, thereby preventing the first mating formatting from disengaging from the second mating formation 41 before the first interrupted thread 34 is disengaged from the second interrupted thread 44. This engagement may be characterized under a variety of known descriptors, including but not limited to quarter-turn locks, cam locks, compression locks, or any other locking mechanism that is distinct in operation from the mechanical interlock 13. It is contemplated that this irregular locking feature will prevent the accidental disengagement of the mechanical interlock 13 by requiring a greater force to draw the first interrupted thread 34 past the second interrupted thread 44, thereby enabling the release of the mechanical interlock 13.

Although the invention has been explained in relation to its preferred embodiment, it is to be understood that many other possible modifications and variations can be made without departing from the spirit and scope of the invention as hereinafter claimed.

What is claimed is:

1. A stackable bottle system comprising:

a plurality of interlocking bottles;

each of the plurality of interlocking bottles comprising a core container, a protruding engagement structure, a recessed engagement structure, and a separable seal;

the core container extending between a neck end and a base end;

an opening being formed into the neck end through the protruding engagement structure;

the separable seal being releasably mounted over the opening;

a reservoir being formed into the core container between the base end and the neck end, wherein the reservoir is in fluid communication with the opening;

the protruding engagement structure being integrated into the core container at the neck end, around the opening;

the recessed engagement structure being integrated into the core container at the base end;

at least one mechanical interlock being formed between the protruding engagement structure and the recessed engagement structure, wherein a first mating formation of the mechanical interlock is dispersed along the protruding engagement structure and a second mating formation of the mechanical interlock is dispersed along the recessed engagement structure;

the protruding engagement structure of an arbitrary bottle from the plurality of interlocking bottles being releasably engaged to the recessed engagement structure of an adjacent bottle from the plurality of interlocking bottles by the mechanical interlock;

the neck end of the core container being substantially convex and the base end of the core container being substantially concave; and the base end of the core container of the adjacent bottle being configured to receive the neck end of the arbitrary bottle;

the recessed engagement structure further comprising a seal-receiving cavity;

the separable seal being removably positioned into the seal-receiving cavity, wherein a minimum diameter of the mechanical interlock is greater than a maximum diameter of the separable seal;

the core container further comprising an upper mounting shelf extending radially outwards from the opening, adjacent to the neck end;

the protruding engagement structure further comprising an internal lip extending radially inwards, opposite the first mating formation; and the upper mounting shelf being captured by the internal lip, whereby the protruding engagement structure is rotationally and translationally bound to the core container.

2. The stackable bottle system as claimed in claim 1 comprising:

the core container further comprising a lower mounting shelf extending radially inwards, adjacent to the base end;

the recessed engagement structure further comprising an external lip extending radially outwards, opposite the second mating formation; and the lower mounting shelf being captured by the external lip, whereby the recessed engagement structure is rotationally and translationally bound to the core container.

3. The stackable bottle system as claimed in claim 1 comprising:

the protruding engagement structure further comprising a first collar positioned adjacent to the first mating formation, wherein the first collar conforms to the curvature of the neck end of the arbitrary bottle;

the recessed engagement structure further comprising a second collar positioned adjacent to the second mating formation, wherein the second collar conforms to the curvature of the base end of the adjacent bottle; and the first collar and the second collar being configured to deflect relative to each other across the at least one mechanical interlock.

4. The stackable bottle system as claimed in claim 1 comprising:

the protruding engagement structure further comprising at least one first terminal locking feature;

the recessed engagement structure further comprising at least one second terminal locking feature; and the first terminal locking feature being radially positioned about the opening, wherein the first terminal locking feature is engaged to the second terminal locking feature through rotation of the arbitrary bottle relative to the adjacent bottle.

5. The stackable bottle system as claimed in claim 4 comprising:

the at least one first terminal locking feature being a first interrupted thread positioned adjacent to the first mating formation proximal to the core container;

the at least one second terminal locking feature being a second interrupted thread, positioned adjacent to the second mating formation proximal to the core container; and the first interrupted thread and the second interrupted thread being removably engaged with each other.

* * * * *